US005198045A

United States Patent [19]

Cho et al.

[11] Patent Number: 5,198,045

[45] Date of Patent: Mar. 30, 1993

[54] LOW DENSITY HIGH STRENGTH AL-LI ALLOY

[75] Inventors: Alex Cho, Richmond, Va.; Joseph R. Pickens, Beltsville, Md.

[73] Assignee: Reynolds Metals Company, Richmond, Va.

[21] Appl. No.: 699,540

[22] Filed: May 14, 1991

[51] Int. Cl.[5] ..... C22F 1/04; C22C 21/12

[52] U.S. Cl. ..... 148/552; 148/417; 148/439; 148/693; 148/697; 148/700; 420/529; 420/532; 420/533; 420/543

[58] Field of Search ..... 148/2, 11.5 A, 12.7 A, 148/159, 552, 693, 697, 700, 417, 439, ; 420/529, 532, 533, 543

[56] References Cited

U.S. PATENT DOCUMENTS

| | | | |
|---|---|---|---|
| 2,293,864 | 8/1942 | Stroup | 420/533 |
| 3,081,534 | 3/1963 | Bredzs | 228/219 |
| 3,306,717 | 2/1967 | Lindstrand et al. | 428/652 |
| 3,346,370 | 10/1967 | Jagaciak | 420/535 |
| 3,765,877 | 10/1973 | Sperry et al. | 420/535 |
| 3,773,502 | 11/1973 | Horvath et al. | 420/531 |
| 3,876,474 | 4/1975 | Watts et al. | 148/32 |
| 3,984,260 | 10/1976 | Watts et al. | 148/32 |
| 4,094,705 | 6/1978 | Sperry et al. | 148/2 |
| 4,297,976 | 11/1981 | Bruni et al. | 420/534 |
| 4,409,033 | 10/1983 | Weber | 148/12.7 A |
| 4,434,014 | 2/1984 | Smith | 148/3 |
| 4,526,630 | 7/1985 | Field | 148/159 |
| 4,532,106 | 7/1985 | Pickens | 420/528 |
| 4,571,272 | 2/1986 | Grimes | 148/11.5 A |
| 4,582,544 | 4/1986 | Grimes et al. | 148/11.5 A |
| 4,584,173 | 4/1986 | Gray et al. | 420/533 |
| 4,588,553 | 5/1986 | Evans et al. | 420/533 |
| 4,594,222 | 6/1986 | Heck et al. | 420/529 |
| 4,603,029 | 7/1986 | Quist et al. | 420/535 |

(List continued on next page.)

FOREIGN PATENT DOCUMENTS

| | | |
|---|---|---|
| 0158571 | 10/1985 | European Pat. Off. . |
| 0227563 | 7/1987 | European Pat. Off. . |
| 3346882 | 6/1984 | Fed. Rep. of Germany . |
| 2561261 | 9/1985 | France . |
| WO 89/01531 | 7/1988 | PCT Int'l Appl. . |
| WO 90/02211 | 7/1989 | PCT Int'l Appl. . |
| 1172736 | 2/1967 | United Kingdom . |
| 2121822 | 1/1984 | United Kingdom . |
| 2134925 | 8/1984 | United Kingdom . |

OTHER PUBLICATIONS

Aluminum Association, "Aluminum Standards and Data 1988", cover page, pp. 15, 16.

Letter dated Oct. 17, 1990 from Aluminum Association Incorporated to signatories of the Declaration of Accord.

"Registration Record of Aluminum Association Alloy Designations and Chemical Composition Limits for Aluminum Alloys in the Form of Castings and Ingot", the Aluminum Association, Inc., Revised Jan. 1989.

R. J. Rioja et al, "Structure-Property Relationships in AL-L1 Alloy: Plate and Sheet Products" Westec Conference, 1990, pp. 1-5, Tables 1-3 and FIGS. 1-22.

*Primary Examiner*—R. Dean

*Assistant Examiner*—Robert R. Koehler

*Attorney, Agent, or Firm*—Alan M. Biddison

[57] ABSTRACT

An aluminum based alloy useful in aircraft and aerospace structures which has low density, high strength and high fracture toughness consists essentially of the following formula:

$$Cu_aLi_bMg_cAg_dZr_eAl_{bal}$$

wherein a, b, c, d, e and bal indicate the amount in wt. % of alloying components, and wherein $2.4<a<3.5$, $1.35<b<1.8$, $0.25<c<0.65$, $0.25<d<0.65$ and $0.08<e<0.25$, and the alloy has a density of 0.0945 to 0.0960 lbs/in$^3$. Preferably, the relationship between the copper and lithium components also meets the following tests: more preferably the relationship meets the following tests:

$$6.5<a+2.5b<7.5,\ 2b-0.8<a<3.75b-1.9.$$

13 Claims, 6 Drawing Sheets

U.S. PATENT DOCUMENTS 4,624,717 11/1986 Miller ..... 148/12.7 A
4,626,409 12/1986 Miller ..... 420/533
4,635,842 1/1987 Mohondro ..... 228/175
4,636,357 1/1987 Peel et al. ..... 420/532
4,648,913 3/1987 Hunt, Jr. et al. ..... 148/12.7 A
4,652,314 3/1987 Meyer ..... 148/2
4,661,172 4/1987 Skinner et al. ..... 148/12.7 A
4,681,736 7/1987 Kersker et al. ..... 420/535
4,690,840 9/1987 Gauthier et al. ..... 427/436
4,735,774 4/1988 Narayanan et al. ..... 420/533
4,752,343 6/1988 Dubost et al. ..... 148/12.7 A
4,758,286 7/1988 Dubost et al. ..... 148/12.7 A
4,790,884 12/1988 Young et al. ..... 148/2
4,795,502 1/1989 Cho ..... 148/2
4,806,174 2/1989 Cho et al. ..... 148/12.7 A
4,816,087 3/1989 Cho ..... 148/2
4,832,910 5/1989 Rioja et al. ..... 420/528
4,840,682 6/1989 Curtis et al. ..... 148/12.7 A
4,844,750 7/1989 Cho et al. ..... 148/12.7 A
4,861,391 8/1989 Rioja et al. ..... 148/12.7 A
4,869,870 9/1989 Rioja et al. ..... 420/532
4,889,569 12/1989 Graham et al. ..... 148/130
4,897,126 1/1990 Bretz et al. ..... 148/12.7 A
4,897,127 4/1990 Huang ..... 148/133
4,915,747 4/1990 Cho ..... 148/12.7 A
4,921,548 5/1990 Cho ..... 148/12.7 A
4,923,532 5/1990 Zedalis et al. ..... 148/159
5,032,359 7/1991 Pickens et al. ..... 420/533

$T_1$ $\delta'$ $T_1$ $\delta'$

LOW DENSITY HIGH STRENGTH AL-LI ALLOY

FIELD OF THE INVENTION

This invention relates to an improved aluminum lithium alloy and more particularly relates to an aluminum lithium alloy which contains copper, magnesium and silver and is characterized as a low density alloy with improved fracture toughness suitable for aircraft and aerospace applications.

BACKGROUND

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have improved ductility, fracture toughness, and strength properties.

With respect to conventional alloys, both high strength and high fracture toughness appear to be quite difficult to obtain when viewed in light of conventional alloys such as AA (Aluminum Association) 2024-T3X and 7050-T7X normally used in aircraft applications. For example, it was found for AA2024 sheet that toughness decreases as strength increases. Also, it was found that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased provides a remarkably unique aluminum lithium alloy product.

It is known that the addition of lithium to aluminum alloys reduces their density and increases their elastic moduli producing significant improvements in specific stiffnesses. Furthermore, the rapid increase in solid solubility of lithium in aluminum over the temperature range of 0° to 500° C. results in an alloy system which is amenable to precipitation hardening to achieve strength levels comparable with some of the existing commercially produced aluminum alloys. However, the demonstratable advantages of lithium containing aluminum alloys have been offset by other disadvantages such as limited fracture toughness and ductility, delamination problems and poor stress corrosion cracking resistance.

Thus only four lithium containing alloys have achieved usage in the aerospace field These are two American alloys, AAX2020 and AA2090, a British alloy AA8090 and a Russian alloy AA01420.

An American alloy, AAX2020, having a nominal composition of Al-4.5Cu-1.1Li-0.5Mn-0.2Cd (all figures relating to a composition now and hereinafter in wt. %) was registered in 1957. The reduction in density associated with the 1.1% lithium addition to AAX2020 was 3% and although the alloy developed very high strengths, it also possessed very low levels of fracture toughness, making its efficient use at high stresses inadvisable. Further ductility related problems were also discovered during forming operations. Eventually, this alloy was formally withdrawn.

Another American alloy, AA2090, having a composition of Al-2.4 to 3.0 Cu-1.9 to 2.6 Li-0.08 to 0.15 Zr, was registered with the Aluminum Association in 1984. Although this alloy developed high strengths, it also possessed poor fracture toughness and poor short transverse ductility associated with delamination problems and has not had wide range commercial implementation. This alloy was designed to replace AA 7075-T6 with weight savings and higher modulus. However, commercial implementation has been limited.

A British alloy, AA8090, having a composition of Al-1.0 to 1.6 Cu-0.6 to 1.3 Mg-2.2 to 2.7 Li-0.04 to 0.16 Zr, was registered with the Aluminum Association in 1988. The reduction in density associated with 2.2 to 2.7 wt. Li was significant. However, its limited strength capability with poor fracture toughness and poor stress corrosion cracking resistance prevented AA8090 from becoming a widely accepted alloy for aerospace and aircraft applications.

A Russian alloy, AA01420, containing Al-4 to 7 Mg-1.5 to 2.6 Li-0.2 to 1.0 Mn-0.05 to 0.3 Zr (either or both of Mn and Zr being present), was described in U.K. Pat. No. 1,172,736 by Fridlyander et al. The Russian alloy AA01420 possesses specific moduli better than those of conventional alloys, but its specific strength levels are only comparable with the commonly used 2000 series aluminum alloys so that weight savings can only be achieved in stiffness critical applications.

Alloy AAX2094 and alloy AAX2095 were registered with the Aluminum Association in 1990. Both of these aluminum alloys contain lithium. Alloy AAX2094 is an aluminum alloy containing 4.4–5.2 Cu, 0.01 max Mn, 0.25–0.6 Mg, 0.25 max Zn, 0.04–0.18 Zr, 0.25–0.6 Ag, and 0.8–1.5 Li. This alloy also contains 0.12 max Si, 0.15 max Fe, 0.10 max Ti, and minor amounts of other impurities. Alloy AAX2095 contains 3.9–4.6 Cu, 0.10 max Mn, 0.25–0.6 Mg, 0.25 max Zn, 0.04–0.18 Zr, 0.25–0.6 Ag, and 1.0–1.6 Li. This alloy also contains 0.12 max Si, 0.15 max Fe, 0.10 max Ti, and minor amounts of other impurities.

It is also known from PCT application WO89/01531, published Feb. 23, 1989, of Pickens et al, that certain aluminum-copper-lithium-magnesium-silver alloys possess high strength, high ductility, low density, good weldability, and good natural aging response. These alloys are indicated in the broadest disclosure as consisting essentially of 2.0 to 9.8 weight percent of an alloying element which may be copper, magnesium, or mixtures thereof, the magnesium being at least 0.01 weight percent, with about 0.01 to 2.0 weight percent silver, 0.05 to 4.1 weight percent lithium, less than 1.0 weight percent of a grain refining additive which may be zirconium, chromium, manganese, titanium, boron, hafnium, vanadium, titanium diboride, or mixtures thereof. A review of the specific alloys disclosed in this PCT application, however, identifies three alloys, specifically alloy 049, alloy 050, and alloy 051. Alloy 049 is an aluminum alloy containing in weight percent 6.2 Cu, 0.37 Mg, 0.39 Ag, 1.21 Li, and 0.17 Zr. Alloy 050 does not contain any copper; rather alloy 050 contains large amounts of magnesium, in the 5.0 percent range. Alloy 051 contains in weight percent 6.51 copper and very low amounts of magnesium, in the 0.40 range. This application also discloses other alloys identified as alloys 058, 059, 060, 061, 062, 063, 064, 065, 066, and 067. In all of these alloys, the copper content is either very high, i.e., above 5.4, or very low, i.e., less than 0.3. Also, Table XX shows various alloy compositions; however, no properties are given for these compositions. PCT Application No. WO90/02211, published Mar. 8, 1990, discloses similar alloys except that they contain no Ag.

It is also known that the inclusion of magnesium with lithium in an aluminum alloy may impart high strength and low density to the alloy, but these elements are not of themselves sufficient to produce high strength without other secondary elements. Secondary elements such as copper and zinc provide improved precipitation hardening response; zirconium provides grain size control, and elements such as silicon and transition metal elements provide thermal stability at intermediate temperatures up to 200° C. However, combining these elements in aluminum alloys has been difficult because of the reactive nature in liquid aluminum which encourages the formation of coarse, complex intermetallic phases during conventional casting.

Therefore, considerable effort has been directed to producing low density aluminum based alloys capable of being formed into structural components for the aircraft and aerospace industries. The alloys provided by the present invention are believed to meet this need of the art.

The present invention provides an aluminum lithium alloy with specific characteristics which are improved over prior known alloys. The alloys of this invention, which have the precise amounts of the alloying components described herein, in combination with the atomic ratio of the lithium and copper components and density, provide a select group of alloys which has outstanding and improved characteristics for use in the aircraft and aerospace industry.

SUMMARY OF THE INVENTION

It is accordingly one object of the present invention to provide a low density, high strength aluminum based alloy which contains lithium, copper, and magnesium.

A further object of the invention is to provide a low density, high strength, high fracture toughness aluminum based alloy which contains critical amounts of lithium, magnesium, silver and copper.

A still further object of the invention is to provide a method for production of such alloys and their use in aircraft and aerospace components.

Other objects and advantages of the present invention will become apparent as the description thereof proceeds.

In satisfaction of the foregoing objects and advantages, there is provided by the present invention an aluminum based alloy consisting essentially of the following formula:

$$Cu_aLi_bMg_cAg_dZr_eAl_{bal}$$

wherein a, b, c, d, e, and bal indicate the amounts in weight percent of each alloying component present in the alloy, and wherein the letters a, b, c, d and e have the indicated values and meet the following specified relations:

$$2.4 < a < 3.5$$
$$1.35 < b < 1.8$$
$$6.5 < a + 2.5\,b < 7.5$$
$$2\,b - 0.8 < a < 3.75\,b - 1.9$$
$$.25 < c < .65$$
$$.25 < d < .65$$
$$.08 < e < .25$$

with up to 0.25 wt. % each of impurities such as Si, Fe, and Zn and up to a maximum total of 0.5 wt. %. Preferably, no one impurity, other than Si, Fe, and Zn, is present in an amount greater than 0.05 weight %, with the total of such other impurities being preferably less than 0.15 weight %. The alloys are also characterized by a Li:Cu atomic ratio of 3.58 to 6.58 and a density ranging from 0.0940 to 0.0965, preferably from 0.0945 to 0.0960, lbs/in$^3$.

The present invention also provides a method for preparation of products using the alloy of the invention which comprises a) casting billets or ingots of the alloy;

b) relieving stress in the billet or ingots by heating at temperatures of approximately 600° to 800° F.;

c) homogenizing the grain structure by heating the billet or ingot and cooling;

d) heating up to about 1000° F. at the rate of 50° F./hour;

e) soaking at elevated temperature;

f) fan cooling to room temperature; and g) working to produce a wrought product.

Also provided by the present invention are aircraft and aerospace structural components which contain the alloys of the invention.

BRIEF DESCRIPTION OF THE DRAWINGS

Reference is now made to the drawings illustrating the invention wherein.

DESCRIPTION OF PREFERRED EMBODIMENTS

Figure 1:
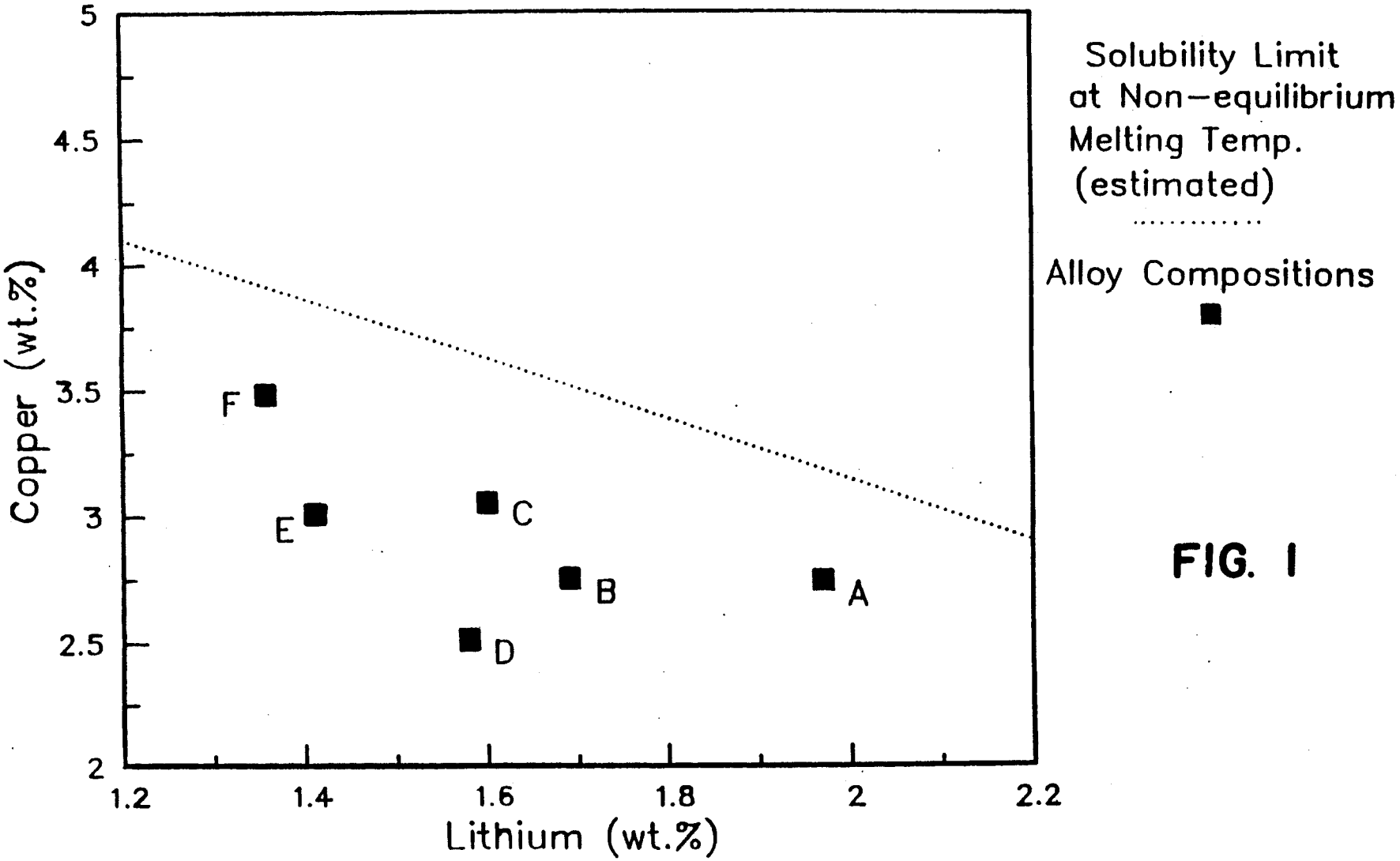
FIG. 1 is a graph showing the total solute content of alloys falling within the scope of the present invention and of alloys not within the scope of the present invention, based on the relationship of the copper and lithium contents.

The objective of this invention is to provide a low density Al-Li alloy which provides the combined properties of high strength and high fracture toughness which is better than or equal to alloys of the prior art with weight savings and higher modulus. The present invention meets the need for a low density, high strength alloy with acceptable mechanical properties including the combined properties of strength and toughness equal to or better than prior art alloys.

Since the cost of Al-Li alloys is three to five times higher than that of conventional alloys, favorable buyto-fly-ratio items such as thin gauge plate or sheet products are the primary target areas for commercial implementations of such Al-Li alloys. Therefore, in developing a new, low density alloy for high strength, high toughness applications, a particular emphasis has been given to plane stress fracture toughness.

The present invention provides a low density aluminum based alloy which contains copper, lithium, magnesium, silver and one or more grain refining elements as essential components. The alloy may also contain incidental impurities such as silicon, iron and zinc. Suitable grain refining elements include one or a combination of the following: zirconium, titanium, manganese, hafnium, scandium and chromium. The aluminum based low density alloy of the invention consists essentially of the formula:

$$Cu_aLi_bMg_cAg_dZr_eAl_{bal}$$

wherein a, b, c, d, and e indicate the amount of each alloying component in weight percent and bal indicates the remainder to be aluminum which may include impurities and/or other components such as grain refining elements.

The preferred embodiment of the invention is an alloy wherein the letters a, b, c, d and e have the indicated values and meet the following specified relations:

$$2.4 < a < 3.5$$
$$1.35 < b < 1.8$$
$$6.5 < a + 2.5\,b < 7.5$$
$$2\,b - 0.8 < a < 3.75\,b - 1.9$$
$$.25 < c < .65$$
$$.25 < d < .65$$
$$.08 < e < .25$$

with up to 0.25 wt. % each of impurities such as Si and Fe and up to a maximum total of 0.5 wt. %. An even more preferred composition has the value of e between 0.08 and 0.16. Other grain refining elements may be added in addition to or in place of zirconium. The purpose of adding grain refining elements is to control grain sizes during casting or to control recrystallization during heat treatment following mechanical working. The maximum amount of one grain refining element can be up to about 0.5 wt. % and the maximum amount of a combination of grain refining elements can be up to about 1.0 wt. %.

The most preferred composition is the following alloy:

$$Cu_aLi_bMg_cAg_dZr_eAl_{bal}$$

wherein a is 3.05, b is 1.6, c is 0.33, d is 0.39, e is 0.15, and bal indicates that Al and incidental impurities are the balance of the alloy. This alloy has a density of 0.0952 lbs./in$^3$.

While providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization to homogenize the internal structure of the metal. Homogenization temperature may range from 650°-930° F. A preferred time period is about 8 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituents to promote workability, this homogenization treatment is important in that it is believed to precipitate dispersoids which help to control final grain structure.

After the homogenizing treatment, the metal can be rolled or extruded or otherwise subjected to working operations to produce stock such as sheet, plate or extrusions or other stock suitable for shaping into the end product.

That is, after the ingot or billet has been homogenized it may be hot worked or hot rolled. Hot rolling may be performed at a temperature in the range of 500° to 950° F. with a typical temperature being in the range of 600° to 900° F. Hot rolling can reduce the thickness of an ingot to one-fourth of its original thickness or to final gauge, depending on the capability of the rolling equipment. Cold rolling may be used to provide further gauge reduction.

The rolled material is preferably solution heat treated typically at a temperature in the range of 960° to 1040° F. for a period in the range of 0.25 to 5 hours. To further provide for the desired strength and fracture toughness necessary to the final product and to the operations in forming that product, the product should be rapidly quenched or fan cooled to prevent or minimize uncontrolled precipitation of strengthening phases. Thus, it is preferred in the practice of the present invention that the quenching rate be at least 100° F. per second from solution temperature to a temperature of about 200° F. or lower. A preferred quenching rate is at least 200° F. per second from the temperature of 940° F. or more to the temperature of about 200° F. After the metal has reached a temperature of about 200° F., it may then be air cooled. When the alloy of the invention is slab cast or roll cast, for example, it may be possible to omit some or all of the steps referred to hereinabove, and such is contemplated within the purview of the invention.

After solution heat treatment and quenching as noted, the improved sheet, plate or extrusion or other wrought products are artificially aged to improve strength, in which case fracture toughness can drop considerably. To minimize the loss in fracture toughness associated with improvement in strength, the solution heat treated and quenched alloy product, particularly sheet, plate or extrusion, prior to artificial aging, may be stretched, preferably at room temperature.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Preferably, artificial aging is accomplished by subjecting the alloy product to a temperature in the range of 275° to 375° F. for a period of at least 30 minutes. A suitable aging practice contemplates a treatment of about 8 to 24 hours at a temperature of about 320° F. Further, it will be noted that the alloy product in accordance with the present invention may be subjected to any of the typical underaging treatments well known in the art, including natural aging. Also, while reference has been made to single aging steps, multiple aging steps, such as two or three aging steps, are contemplated to improve properties, such as to increase the strength and/or to reduce the severity of strength anisotropy.

For example, with prior art aluminum alloy AA X2095, a rolled plate of 1.5" gauge was processed by a novel two step aging practice to reduce the degree of strength anisotropy by about 8 ksi or by approximately 40%. A brief description of the novel process follows:

A 1.5" gauge rolled plate was heat treated, quenched, and stretched by 6%. When a conventional one step age at 290° F. for 20 hours was employed, the highest tensile yield stress of 87 ksi was obtained in the longitudinal direction at T/2 plate locations, while the lowest tensile yield strength of 67 ksi was obtained in the 45 degree direction in regard to the rolled direction at T/8 plate locations. The strength difference of 20 ksi resulted from the inherent strength anisotropy of the plate. When a novel multiple step aging practice was used, that is, a first step of 290° F. for 20 hours, a ramped age from 290° F. to 400° F., at a heat up rate of 50° F. per hour, followed by a 5 minutes soak at 400° F., a tensile yield stress of 87.4 ksi was obtained in the longitudinal direction at T/2 plate locations, while a tensile yield strength of 75.5 ksi was obtained in the 45 degree direction in regard to the rolled direction at T/8 plate locations. The strength difference between the highest and lowest measured strength values was only 12 ksi. This value should be compared with the 20 ksi difference obtained when the conventional single step practice was used. Some improvements were also observed by employing other two step aging practices, such as, for example, the same first step mentioned above and a second step of 360° F. for 1 to 2 hours.

Similar improvements are expected with the presently invented alloy by employing the novel two step aging practice.

Stretching or its equivalent working may be used prior to or even after part of such multiple aging steps to also improve properties.

The aluminum lithium alloys of the present invention provide outstanding properties for a low density, high strength alloy. In particular, the alloy compositions of the present invention exhibit an ultimate tensile strength (UTS) as high as 84 ksi, with an ultimate tensile strength (UTS) which ranges from 69–84 ksi depending on conditioning, a tensile yield strength (TYS) of as high as 78 ksi and ranging from 62–78 ksi, and an elongation of up to 11%. These properties are even higher for plate gauge products. These are outstanding properties for a low density alloy and make the alloy capable of being formed into structural components for use in aircraft and aerospace applications. It has been particularly found that the combination of and critical control of the amounts of copper, lithium, magnesium, and silver alloying components and the copper-lithium atomic ratio enable one to obtain a low density alloy having excellent tensile strength and elongation.

In a preferred method of the invention, the alloy is formulated in molten form and then cast into a billet. Stress is then relieved in the billet by heating at 600° F. to 800° F. for 6 to 10 hours. The billet, after stress relief, can be cooled to room temperature and then homogenized or can be heated from the stress relief temperature to the homogenization temperature. In either case, the billet is heated to a temperature ranging from 960° F. to 1000° F., with a heat up rate of about 50° F. per hour, soaked at such temperature for 4 to 24 hours, and air cooled. Thereafter, the billet is converted into a usable article by conventional mechanical deformation techniques such as rolling, extrusion or the like. The billet may be subjected to hot rolling and preferably is heated to about 900° F. to 1000° F. so that hot rolling can be initiated at about 900° F. The temperature is maintained between 900° F. and 700° F. during hot rolling. After the billet has been hot rolled to form a thick plate product (thickness of at least 1.5 inches), the product is generally solution heat treated. A heat treatment may include soaking at 1000° F. for one hour followed by a cold water quench. After the product has been heat treated, the product is generally stretched 5 to 6%. The product then can be further treated by aging under various conditions but preferably at 320° F. for eight hours for underaged condition, or at 16 to 24 hours for peak strength conditions.

In a variation of the preceding, the thick plate product is reheated to a temperature between about 900° F. and 1000° F. and then hot rolled to a thin gauge plate product (gauge less than 1.5 inches). The temperature is maintained during rolling between about 900° F. and 600° F. The product is then subjected to heat treatment, stretching and aging similar to that used with the thick plate product.

In still another variation, the thick plate product is hot rolled to produce a thin plate having a thickness about 0.125 inches. This product is annealed at a temperature in the range of about 600° F. to 700° F. for from about 2 hours to 8 hours. The annealed plate is cooled to ambient and then cold rolled to final sheet gauge. This product, like the thick plate and thin plate products, is then heat treated, stretched, and aged.

With certain embodiments of the alloy according to the present invention, the preferred processing for thin gauge products (both sheet and plate), prior to solution heat treating, includes annealing the product at a temperature between about 600° F. and about 900° F. for 2 to 12 hours or a ramped anneal that heats the product from about 600° F. to about 900° F. at a controlled rate.

Aging is carried out to increase the strength of the material while maintaining its fracture toughness and other engineering properties at relatively high levels. Since high strength is preferred in accordance with this invention, the product is aged at about 320° F. for 16–24 hours to achieve peak strength. At higher temperatures, less time will be needed to attain the desired strength levels than at lower aging temperatures.

The following examples are presented to illustrate the invention, but the invention is not to be considered as limited thereto.

The following alloys of Table I were prepared in accordance with the invention:

TABLE I

| Alloy | Density (#/in$^3$) | Chemical Compositions of Alloys Li:Cu (atomic) | Cu (%) | Li (%) | Mg (%) | Ag (%) | Zr (%) |
|---|---|---|---|---|---|---|---|
| A | .0941 | 6.58 | 2.74 | 1.97 | .3 | .38 | .15 |
| B | .0948 | 5.63 | 2.75 | 1.69 | .34 | .39 | .13 |
| C | .0952 | 4.80 | 3.05 | 1.60 | .33 | .39 | .15 |
| D | .0950 | 5.76 | 2.51 | 1.58 | .37 | .37 | .15 |
| E | .0958 | 4.29 | 3.01 | 1.41 | .42 | .40 | .14 |
| F | .0963 | 3.58 | 3.48 | 1.36 | .36 | .40 | .13 |

Note:
1. Chemistry analysis were conducted by ICP (inductively coupled plasma) technique from .75" gauge plate.
2. All the compositions are in weight %.

1. Alloy Selection

The compositions of the alloys, as shown in TABLE I, were selected based on the following considerations:

a. Density

The target density range is between 0.094 and 0.096 pounds per cubic inch. The calculated values of the density of the alloys are 0.0941, 0.0948, 0.0950, 0.0952, 0.0958, and 0.0963 pounds per cubic inch. It is noted that the density of three alloys, B,C, and D, is approximately 0.095 pounds per cubic inch so that the effect of other variables can be examined. In this work, the density of the six alloys was controlled by varying Li:Cu ratio or the total Cu and Li content while Mg, Ag, and Zr contents were nominally 0.4 wt. %, 0.4 wt. %, and 0.14 wt. %, respectively.

b. Li:Cu Ratio

For an Al-Cu-Li based alloy system, δ' phase and $T_1$ phase are the predominant strengthening precipitates. However, δ' precipitates are prone to shearing by dislocations and lead to planar slip and strain localization behavior, which adversely affects fracture toughness. Since Li:Cu ratio is the dominant variable controlling precipitation partitioning between δ' and $T_1$ phases, the six alloy compositions were selected with Li:Cu atomic ratios ranging from 3.58 to 6.58. Therefore, fracture toughness and Li:Cu ratio can be correlated and a critical Li:Cu ratio can be identified for acceptable fracture characteristics.

c. Total Solute Content

As shown in FIG. 1, all six alloy compositions were chosen to be below the estimated solubility limit curve at non-equilibrium melting temperatures to ensure good fracture toughness at the given Li:Cu ratio. At a given Li:Cu ratio, as the total solute content decreases, so does strength To evaluate the strength decrease due to low total solute content at a given Li:Cu ratio, alloy D was selected to compare with alloy B in strength and toughness.

2. Casting and Homogenization

The six compositions were cast as direct chilled (DC) 9" diameter round billets. The billets were stress relieved for 8 hours at temperatures from 600° F. to 800° F.

The billets were sawed and homogenized by a two step practice:

1. Heat to 940° F. at 50° F./hr.
2. Soak for 8 hrs. at 940° F.
3. Heat up to 1000° F. at 50° F./hr or slower.
4. Soak for 36 hours at 1000° F.
5. Fan cool to room temperature.
6. Machine two sides of the billets by equal amounts to form 6" thick rolling stock for rolling.

3. Hot Rolling

The billets with two flat surfaces were hot rolled to plate and sheet. The hot rolling practices were as follows:

For Plate

1. Preheat at 950° F. and soak for 3 to 5 hours.
2. Air cool to 900° F. before hot rolling.
3. Cross roll to 4" thickness slab.
4. Straight roll to 0.75" gauge plate.
5. Air cool to room temperature.

For Sheet

1. Preheat at 950° F. and soak for 3 to 5 hours.
2. Air cool to 900° F. before hot rolling.
3. Cross roll to 2.5" gauge slab (16" good width).
4. Reheat to 950° F.
5. Air cool to 900° F.
6. Straight roll to 0.125".
7. Air cool to room temperature.

All the hot rolled plate and sheet products were subjected to additional processing as follows.

4. Solution Heat Treat

Plate

All the 0.75" gauge plate products were sawed to 24" lengths and solution heat treated at 1000° F. for 1 hour and cold water quenched. All T3 and T8 temper plate products were stretched 6% within 2 hours.

Sheet

⅛" gauge sheet products were ramp annealed from 600° F. to 900° F. at 50° F./hr followed by solution heat treatment for 1 hour at 1000° F. and cold water quenched. All T3 and T8 temper sheet received 5% stretch within 2 hours.

5. Artificial Age

Plate

In order to develop T8 temper properties, T3 temper plate samples were aged at 320° F. for 12, 16, and/or 32 hours.

Sheet

T3 temper sheet samples were aged at 320° F. for 8 hrs, 16 hrs, and 24 hours to develop T8 temper properties.

6. Mechanical Testing

Plate

Tensile tests were performed on longitudinal 0.350" round specimens. Plane strain fracture toughness tests were performed on W=1.5" compact tension specimens in the L-T direction.

Sheet

Sheet gauge tensile tests were performed on subsize flat tensile specimens with 0.25" wide 1" long reduced section. Plane stress fracture toughness tests were performed on 16" wide 36" long, center notched wide panel fracture toughness test specimens which were fatigue pre-cracked prior to testing.

7. Results and Discussion

Figure 2:
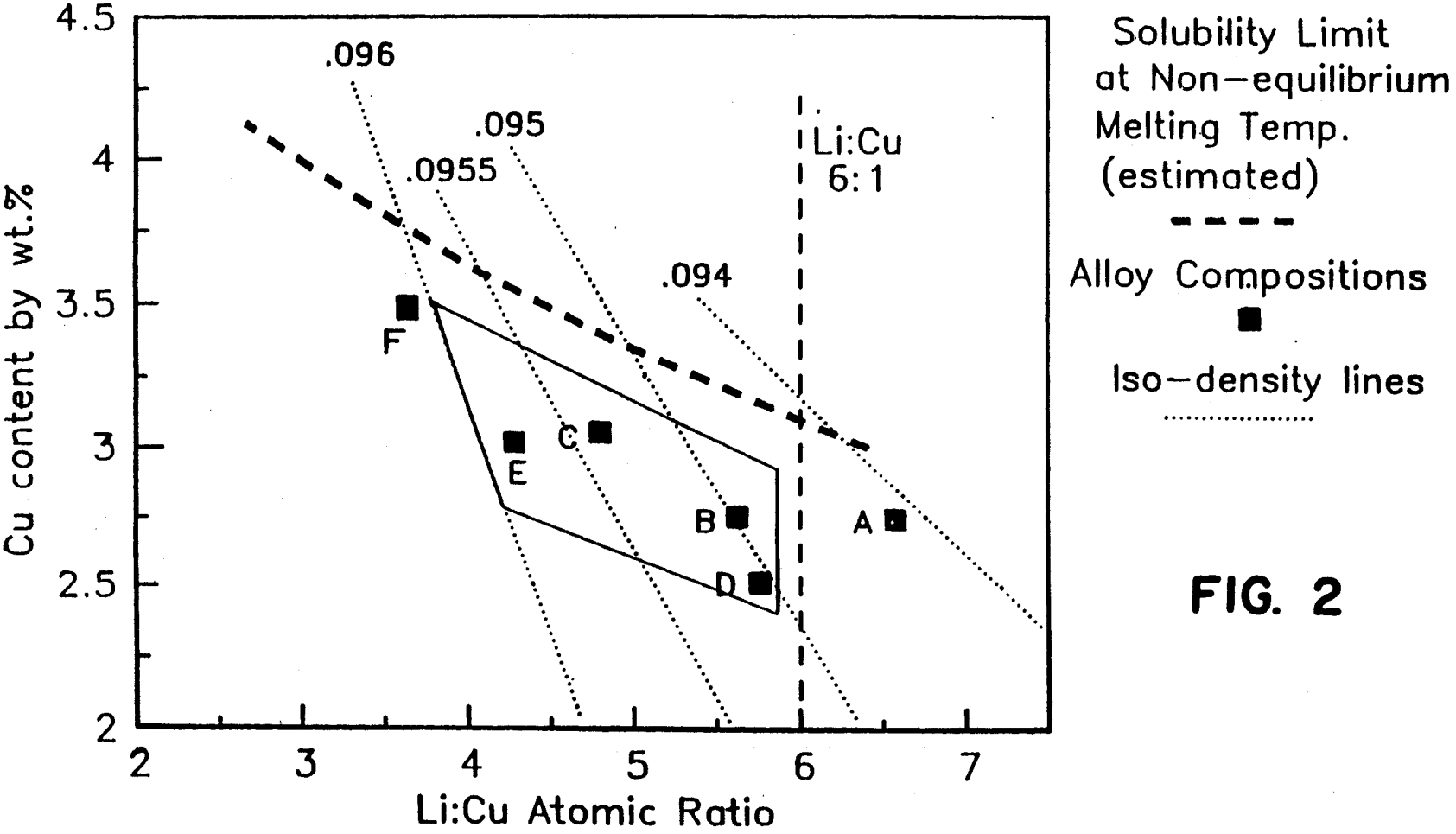
FIG. 2 is a graph comparing the copper content of the alloys depicted in FIG. 1 with their lithium copper atomic ratio.
Figure 3:
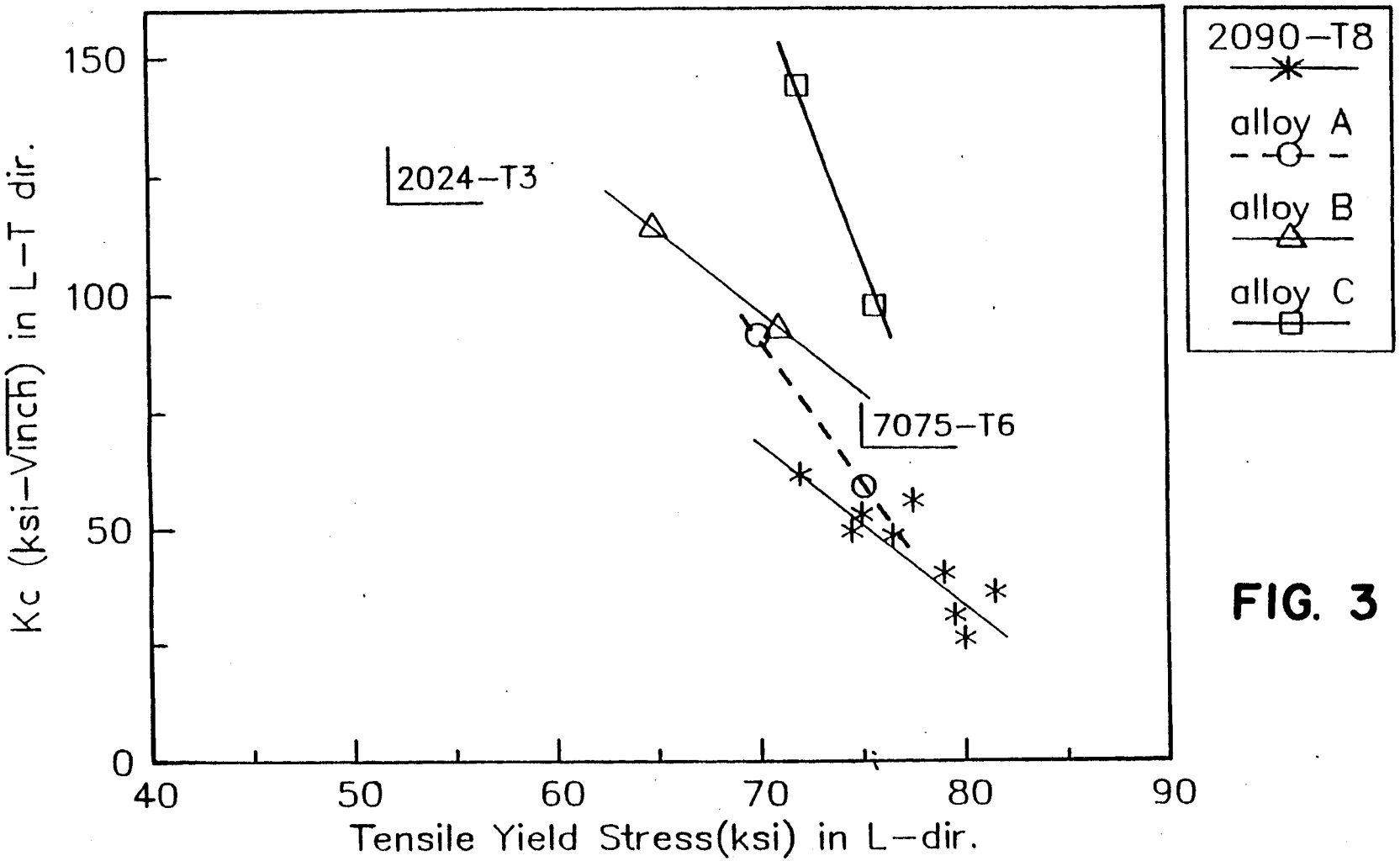
FIG. 3 compares the plane stress fracture toughness and strength of the alloys depicted in FIG. 1.
Figure 4A:
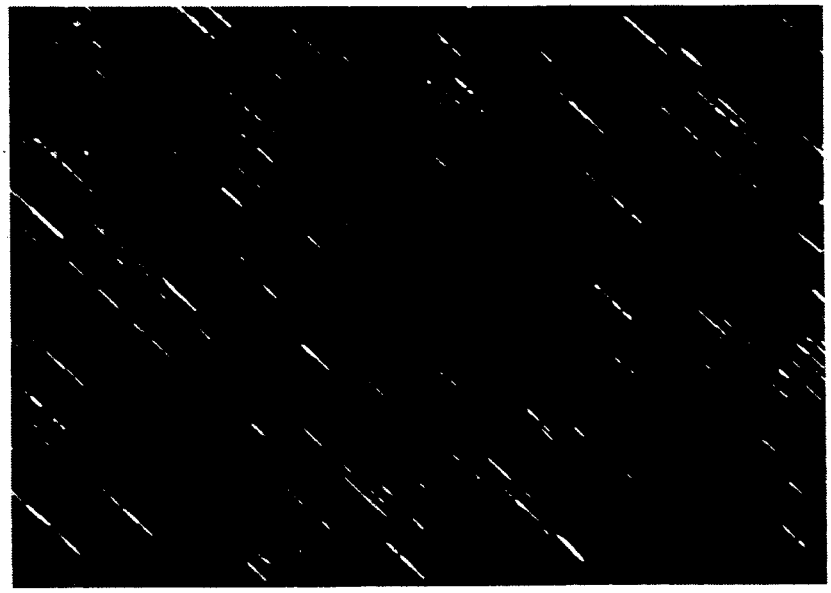
FIG. 4 illustrates transmission electron micrographic examination of alloys of the invention and depicts the density of δ′ precipitates and $T_1$ precipitates.
Figure 4B:
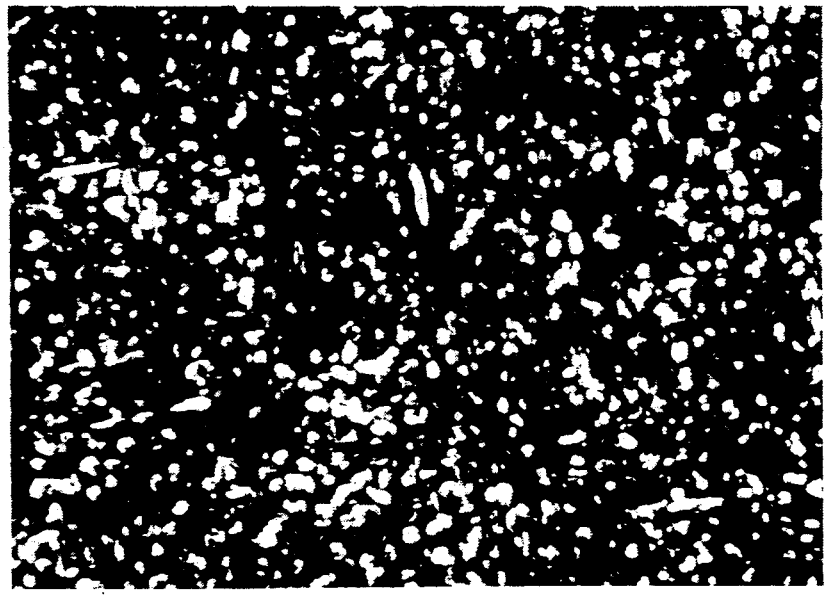
Figure 4C:
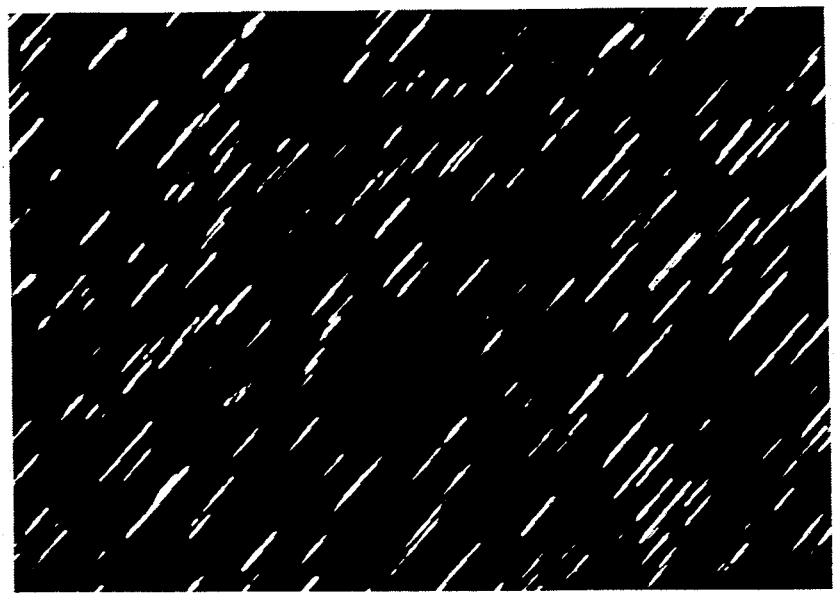
Figure 4D:
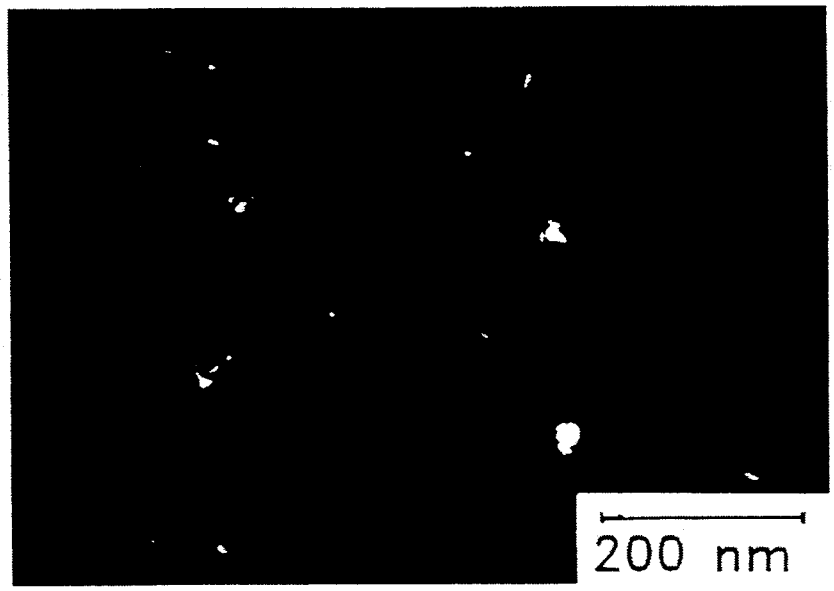

The test results of sheet gauge properties for three alloys, A, B, and C, are listed in Table II. Alloys D, E, and F were not tested in sheet gauge. In FIG. 3, plane stress fracture toughness values are plotted with tensile yield stress for three alloys. In order to compare the strength/toughness properties to other commercial alloys, AA7075-T6 and AA2024-T3 target properties are marked along with alloy AA2090-T8 properties. Alloy AA2090 Sheet Data shown in FIG. 3 are from R. J. Rioja et al, "Structure-Property Relationship in Al-Li Alloy," Westec Conference, 1990. While alloy A performed marginally below the level of AA7075-T6 properties, alloy B and alloy C showed significant improvement over AA7075-T6, as well as over alloy AA2090. Alloy C performed best, alloy B was the second, and alloy A was the third. This trend follows directly with Li:Cu ratio of the three alloys (see FIG. 2). The lower Li:Cu ratio, the better is the fracture toughness. FIG. 2 shows that, to meet the required fracture toughness of AA7075-T6, the preferred Li:Cu atomic ratio should be less than 5.8. The best results can be obtained with Li:Cu ratio of 4.8 for alloy C. The significant difference in plane stress fracture toughness values between alloy A and alloy C demonstrated the metallurgical significance of the Li:Cu ratio. FIG. 4 shows the results from transmission electron microscopic examination of alloy A and alloy C in T8 temper, comparing the density of δ' precipitates and $T_1$ precipitates. Alloy A with Li:Cu ratio of 6.58 contains high density of δ' precipitates which adversely affect fracture toughness. On the contrary, alloy C with Li:Cu ratio of only 4.8, contains mostly $T_1$ phase precipitates with little trace of δ' phase. Since $T_1$ phase particles, unlike δ' phase, are not readily shearable, there is less tendency to planar slip behavior, resulting in more homogeneous slip behavior. It was found that alloys with Li:Cu ratio higher than 5.8 contain significantly higher density of δ' phase precipitates which adversely affects fracture toughness, as in alloy A (FIG. 3).

TABLE II

Mechanical Test Results of 0.125" Gauge Sheet in T8 Temper

| Alloy | Age (hrs./°F.) | | UTS (ksi) | TYS (ksi) | EL (%) | Kc (Kapp.) (ksi – $\sqrt{\text{inch}}$) |
|---|---|---|---|---|---|---|
| A | 8/320 | L | 77.0 | 70.9 | 8.0 | 90.8 (76.2) |
| | | LT | 78.8 | 70.9 | 10.0 | |
| | 16/320 | L | 80.6 | 75.1 | 6.0 | 58.4 (52.5) |
| | | LT | 80.8 | 74.5 | 8.5 | |
| | 24/320 | L | 82.4 | 77.7 | 7.0 | |
| | | LT | 83.4 | 77.8 | 8.0 | |
| B | 8/320 | L | 69.5 | 64.9 | 10.5 | 113.4 (90.1) |
| | | LT | 69.6 | 62.5 | 9.5 | |
| | 16/320 | L | 74.6 | 71.0 | 9.0 | 91.9 (80.9) |
| | | LT | 75.5 | 69.8 | 11.0 | |
| | 24/320 | L | 74.6 | 70.2 | 8.0 | |
| | | LT | 75.4 | 71.1 | 9.5 | |
| C | 8/320 | L | 76.5 | 72.0 | 10.0 | 143.2 (104.2) |
| | | LT | 74.9 | 68.7 | 10.0 | |
| | 16/320 | L | 79.5 | 75.7 | 10.0 | 97.0 (80.8) |
| | | LT | 78.2 | 73.4 | 10.0 | |
| | 24/320 | L | 80.6 | 77.6 | 8.0 | |
| | | LT | 79.5 | 74.3 | 10.5 | |

Note:
1. Tensile test results are averaged values from duplicates.
2. Tensile tests are performed with 0.25" gauge width flat subsize tensile specimens.
3. Plane stress fracture toughness tests were performed on 16" wide 36" long, center notched panels which were fatigue precracked prior to testing.

The results of tensile tests and plane strain fracture toughness tests of 0.75" gauge T8 temper plates are listed in Table III. The results are plotted in FIG. 5 to compare the strength/toughness properties with the baseline Al alloy, AA7075-T651.

TABLE III

Mechanical Test Results of 0.75" Gauge Plate in T8 Temper

| Alloy | Age (hrs./°F.) | UTS (ksi) | TYS (ksi) | EL (%) | Kg (ksi – $\sqrt{\text{inch}}$) |
|---|---|---|---|---|---|
| A | 16/320 | 86.7 | 82.5 | 6.0 | 15.7/16.2 |
| | 24/320 | 87.0 | 83.5 | 5.7 | 14.2/14.5 |
| B | 8/320 | 78.3 | 73.2 | 8.6 | N.A. |
| | 16/320 | 84.4 | 80.3 | 9.3 | 31.7/33.7 |
| | 24/320 | 84.8 | 81.0 | 8.2 | 30.6/28.6 |
| C | 8/320 | 83.2 | 78.9 | 9.3 | N.A. |
| | 16/320 | 85.8 | 81.9 | 7.9 | 24.6 |
| | 24/320 | 85.6 | 82.1 | 6.4 | 22.6 |
| D | 8/320 | 74.0 | 68.2 | 8.6 | N.A. |
| | 16/320 | 77.2 | 73.6 | 10.0 | 36.7 |
| | 24/320 | 78.5 | 75.0 | 9.3 | 30.1 |
| E | 8/320 | 81.7 | 78.4 | 11.0 | 43.9 |
| | 16/320 | 82.6 | 79.1 | 11.0 | 37.7 |
| | 24/320 | 83.6 | 80.3 | 11.0 | 32.7 |
| F | 8/320 | 87.0 | 83.8 | 11.0 | 29.9 |
| | 16/320 | 88.7 | 85.5 | 11.0 | 24.9 |
| | 24/320 | 88.9 | 86.2 | 11.0 | 25.1 |

Note:
1. All the tensile properties are the averaged values from duplicate tests.
2. All the fracture toughness test results are from single tests.
3. Tensile tests were performed with longitudinal 0.350" round specimens.
4. Fracture toughness tests were performed with W = 1.5" Compact Tension specimens.

Figure 5:
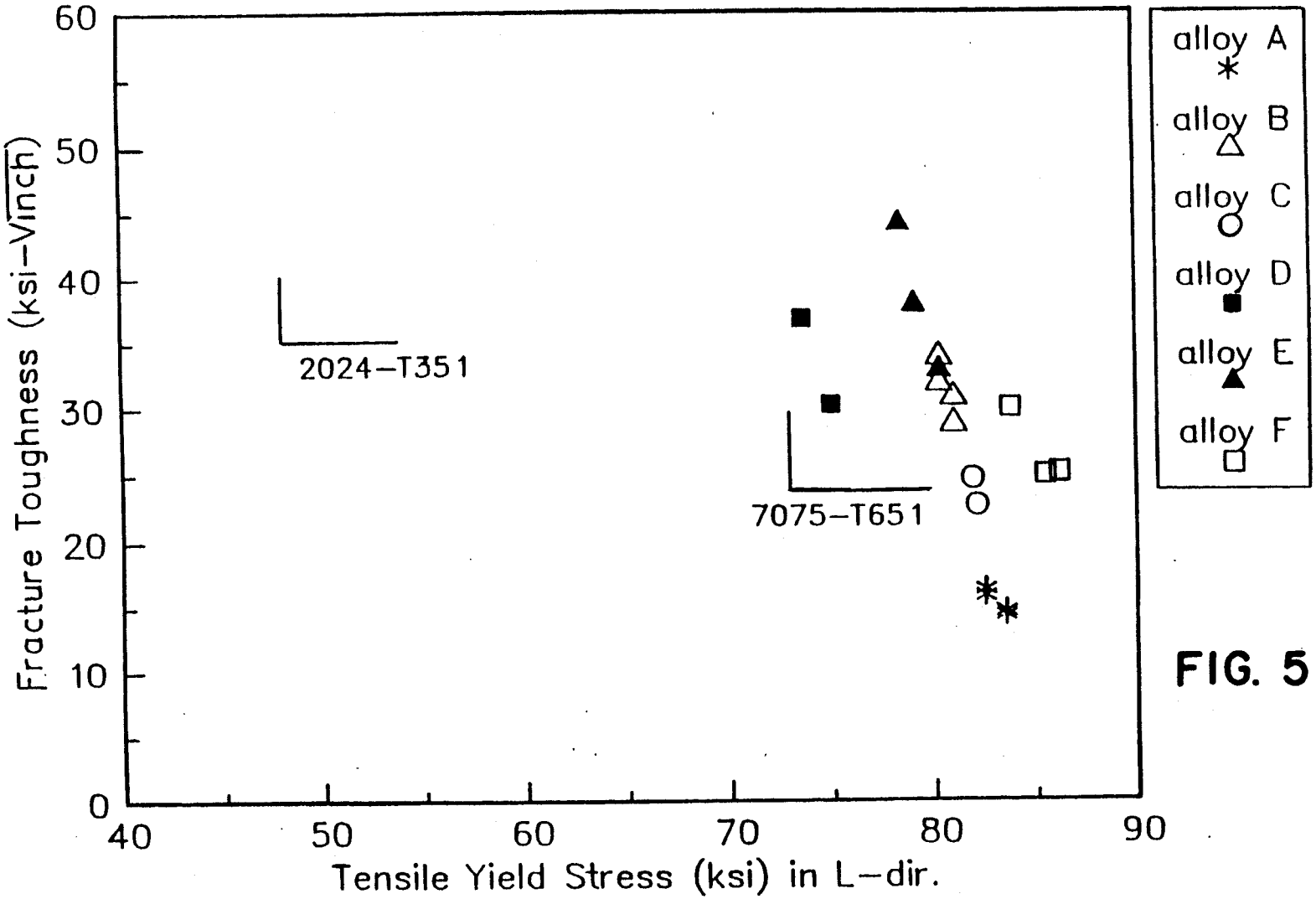
FIG. 5 is a graph showing a comparison of the strength and toughness of aluminum alloys of the invention with prior art alloy standards.

From Table III and FIG. 5, it will be noted that alloys B, C, D, E, and F have good strength/toughness relationships that are better than or comparable to AA7075-T651 plate. However, alloy A, the high Li:Cu ratio alloy, has poor fracture toughness properties compared to AA7075-T651.

Comparing alloy D to alloy B, having comparable Li:Cu ratio, they both have good fracture toughness and meet the strength requirement of AA7075-T651. Due to lower solute content, the strength of alloy D is approximately 7 ksi lower than that of alloy B, but alloy D has slightly higher fracture toughness. A similar observation can be made between alloy C and alloy E. Alloy E, which is 0.5% leaner in Cu compared to the solubility limit at the given Li:Cu ratio, showed higher fracture toughness than alloy C, which is 0.25% leaner in Cu compared to its solubility limit. Alloy E also is slightly lower in strength than alloy C.

Alloy F has high strength with adequate fracture toughness. However, due to the very high Cu content, the density of the alloy is higher than the preferred 0.096 pounds per cubic inch.

As a summary, FIG. 2 illustrates the preferred composition range (a solid line) of a low density, high strength, high toughness alloy to meet the strength-/toughness/density requirement goals to directly replace AA7075-T6 with at least 5% weight savings. The preferred composition range can be constructed based on the following considerations:

1. Fracture Toughness Requirement a. Preferred Li:Cu ratio is less than 5.8.

b. The preferred Cu content should be less than the non-equilibrium solubility limit at a given Li:Cu ratio, preferably at least 0.2% lower than such limit.

The requirement for acceptable Cu content at a given Li:Cu ratio or for a given total solute content needs to be even more restricted if elevated temperature stability is also required for maintaining acceptable fracture toughness properties for a full service life of a structural component made from the alloy. It has been found that, in an elevated temperature environment, the preferred Cu content should be lower than the non-equilibrium solubility limit at a given Li:Cu ratio by at least 0.3%. For example, alloys with a nominal composition, by weight %, of 3.6Cu-1.1Li-0.4Mg-0.4Ag-0.14Zr (0.5% below the solubility limit) and 3.0Cu-1.4Li-0.4Mg-0.4Ag-0.14Zr (0.5% below the solubility limit) are able to maintain fracture toughness values ($K_1c$) above 20 ksi-$\sqrt{\text{inch}}$ for long term exposures, such as 100 hours and 1,000 hours, at various elevated temperatures, such as 300° F., 325° F. and 350° F. In contrast, the fracture toughness values of an alloy with a nominal composition of 3.48Cu-1.36Li-0.4Mg-0.4Ag-0.14Zr (0.25% below the solubility limit) decrease to unacceptable values below 20 kis-$\sqrt{\text{inch}}$ after a thermal exposure at 325° F. for 100 hours. The thermally stable alloy with the best combination of strength and fracture toughness was the alloy with a nominal composition of 3.6Cu-1.1Li-0.4Mg-0.4Ag-0.14Zr.

2. Minimum Strength Requirement

Preferred Cu content should be no less than 0.8% below the solubility limit at a given Li:Cu ratio.

3. Density Requirement

The alloys have densities between 0.0945 and 0.096 pounds per cubic inch. As shown in FIG. 2, Cu and Li content should be to the right hand side of the iso-density line of 0.096.

The preferred composition box for Cu and Li constituents of an alloy meeting the above mechanical and physical property requirements is illustrated in FIG. 2. The values of the corners, in weight percent, are 2.9% Cu-1.8% Li, 3.5% Cu-1.5% Li, 2.75% Cu-1.3% Li and 2.4% Cu-1.6% Li. The following ratios are determined by these values:

$$6.5<(\text{Cu}+2.5\ \text{Li})<7.5;\ \text{and} \quad (1)$$

$$(2\ \text{Li}-0.8)<\text{Cu}<(3.75\ \text{Li}-1.9). \quad (2)$$

The invention has been described herein with reference to certain preferred embodiments. However, as obvious variations thereon will become apparent to those skilled in the art the invention is not to be considered as limited thereto.

We claim:

1. A low density aluminum based alloy consisting essentially of the formula $$Cu_aLi_bMg_cAg_dZr_eAl_{bal}$$

wherein a, b, c, d, e and bal indicate the amount of each alloying component in weight percent and wherein $2.4<a<3.5$, $1.35<b<1.8$, $6.5<a+2.5b<7.5$, $2b-0.8<a<3.75b-1.9$, $0.25<c<0.65$, $0.25<d<0.65$ and $0.08<e<0.25$, the alloy having a density ranging from 0.0945 to 0.0960 lbs/in$^3$, the Li-Cu atomic ratio being maintained between about 3.58 and about 5.8 and the Cu content being less than the non-equilibrium solubility limit at a given Li:Cu atomic ratio, said alloy when processed to the T8 temper containing a minimum of $\delta'$ phase precipitates so that the fracture toughness properties of the alloy are at least as good as the plane stress fracture toughness properties of 7075-T6.

2. An aluminum based alloy according to claim 1, wherein the alloy also contains up to a total of 0.5 wt% of impurities and additional grain refining elements but no single element is present in an amount greater than 0.25 weight %.

3. An aluminum based alloy according to claim 1 which, in sheet product form, has an ultimate tensile strength ranging from 69-84 ksi, a tensile yield strength ranging from 62-78 ksi, and an elongation of up to 11%.

4. An aluminum based alloy according to claim 1 which has a density of about 0.095 lbs/in.$^3$.

5. An aluminum based alloy according to claim 1 which has a Cu:Li ratio falling within an area on a graph having Cu content on one axis and Li content on the other axis, the area being defined by the following corners: (a) 2.9% Cu-1.8% Li; (b) 3.5% Cu-1.51% Li; (c) 2.75% Cu-1.3% Li, and (d) 2.4% Cu-1.6% Li.

6. A low density aluminum alloy consisting essentially of the formula $$Cu_aLi_bMg_cAg_dZr_eAl_{bal}$$

wherein a, b, c, d, e and bal indicate the balance of each alloying component in wt. %, and wherein a is 3.05, b is 1.6, c is 0.33, d is 0.39, e is 0.15 and bal indicates the balance is aluminum and the density is 0.0952 lbs./in$^3$, the Li-Cu atomic ratio being about 4.8 and the Cu content being less than the non-equilibrium solubility limit at a given Li:Cu atomic ratio, said alloy when processed to the T8 temper containing a minimum of $\delta'$ phase precipitates so that the fracture toughness properties of the alloy are at least as good as the plane stress fracture toughness properties of 7075-T6.

7. A method for producing an aluminum alloy product which comprises the following steps:

a) casting an alloy of the following composition as an ingot or billet:

$$Cu_aLi_bMg_cAg_dZr_eAl_{bal}$$

wherein a, b, c, d, e and bal indicate the amount of each alloying component in weight percent and wherein $2.4<a<3.5$, $1.35<b<1.8$, $6.5<a+2.5b<7.5$, $2b-0.8<a<3.75b-1.9$, $0.25<c<0.65$, $0.25<d<0.65$ and $0.08<e<0.25$, the alloy having a density ranging from 0.0945 to 0.0960 lbs/in$^3$, the Li-Cu atomic ratio being maintained between about 3.58 and about 5.8 and the Cu content being less than the non-equilibrium solubility limit at a given Li:Cu atomic ratio, said alloy when processed to the T8 temperature containing a minimum of $\delta'$ phase precipitates so that the fracture toughness properties of the alloy are at least as good as the plane stress fracture toughness properties of 7075-T6;

b) relieving stress in said ingot or billet by heating;

c) homogenizing said ingot or billet by heating, soaking at an elevated temperature and cooling;

d) rolling said ingot or billet to a final gauge product;

e) heat treating said product by soaking and then quenching;

f) stretching the product to 5 to 11%; and g) aging said product by heating.

8. An aerospace airframe structure produced from an aluminum alloy of claim 1.

9. An aerospace airframe structure produced from an aluminum alloy of claim 2.

10. An aircraft airframe structure produced from an aluminum alloy of claim 3.

11. An aircraft airframe structure produced from an aluminum alloy of claim 4.

12. An aircraft airframe structure produced from an aluminum alloy of claim 5.

13. An aircraft airframe structure produced from an aluminum alloy of claim 6.

* * * * *